US010392705B2

(12) United States Patent
Güttler et al.

(10) Patent No.: US 10,392,705 B2
(45) Date of Patent: Aug. 27, 2019

(54) METHOD FOR PREPARING SHAPED METAL BODIES FOR COLD WORKING

(71) Applicant: Chemetall GmbH, Franfurt am Main (DE)

(72) Inventors: Benjamin Güttler, Bad Nauheim (DE); Ralf Schneider, Frankfurt (DE); Frank Hollmann, Biberbach (DE); Gorka De Luis Garcia, Logroño (ES); Iñaki Nieves Quintana, Amurrio (ES); Martin Orben, Schöneck (DE); Norbert Schwinke-Kruse, Bad Münstereifel (DE)

(73) Assignee: Chemetall GmbH, Frankfurt am Main (DE)

( * ) Notice: Subject to any disclaimer, the term of this patent is extended or adjusted under 35 U.S.C. 154(b) by 309 days.

(21) Appl. No.: 15/029,450

(22) PCT Filed: Oct. 16, 2014

(86) PCT No.: PCT/EP2014/072191

§ 371 (c)(1),
(2) Date: Apr. 14, 2016

(87) PCT Pub. No.: WO2015/055756

PCT Pub. Date: Apr. 23, 2015

(65) Prior Publication Data

US 2016/0265116 A1 Sep. 15, 2016

(30) Foreign Application Priority Data

Oct. 17, 2013 (DE) ..... 10 2013 221 107

(51) Int. Cl.
*C23C 22/48* (2006.01)
*C23C 22/46* (2006.01)
(Continued)

(52) U.S. Cl.
CPC ..... *C23C 22/46* (2013.01); *C10M 173/02* (2013.01); *C23C 2/06* (2013.01); *C23C 22/78* (2013.01);
(Continued)

(58) Field of Classification Search
CPC ..... C23C 22/46–22/47
See application file for complete search history.

(56) References Cited

U.S. PATENT DOCUMENTS 2,086,712 A 7/1937 Green
2,550,660 A 5/1951 Amundsen
(Continued)

FOREIGN PATENT DOCUMENTS

DE 2125503 A 12/1972
DE 10305449 A 8/2004
GB 2059445 A 4/1981

*Primary Examiner* — Lois L Zheng
(74) *Attorney, Agent, or Firm* — Armstrong Teasdale LLP

(57) ABSTRACT

Methods for treatment shaped bodies are described herein. The methods generally include contacting at least one shaped body with an aqueous acidic composition to form a conversion layer on a surface of the at least one shaped body, wherein the surface includes iron or steel and a carbon content in a range of 0 to 2.06 wt. % and a chrome content in a range of 0 to <10 wt. % and wherein the surface is optionally galvanized or alloy galvanized. The aqueous acidic composition includes water; from 2 to 500 g/L oxalic acid; and from 0.01 to 20 g/L of at least one catalyst based on guanidine, nitrate or combinations thereof, wherein a pickling removal of the aqueous acidic composition is in a range of 1 to 6 g/m$^2$.

8 Claims, 1 Drawing Sheet

(51) Int. Cl.

| | |
|---|---|
| ***C10M 173/02*** | (2006.01) |
| ***C23C 22/83*** | (2006.01) |
| ***C23C 2/06*** | (2006.01) |
| ***C23C 22/78*** | (2006.01) |
| ***C23C 22/82*** | (2006.01) |

(52) U.S. Cl.
CPC ..... *C23C 22/82* (2013.01); *C23C 22/83* (2013.01); *C10N 2230/06* (2013.01); *C10N 2240/402* (2013.01); *C10N 2280/00* (2013.01)

(56) References Cited

U.S. PATENT DOCUMENTS

| | | | | |
|---|---|---|---|---|
| 2,850,417 | A | 9/1958 | Jenkins et al. | |
| 3,481,762 | A | 12/1969 | Streicher | |
| 2014/0130941 | A1* | 5/2014 | Asano ..... | C23C 22/05 148/267 |

* cited by examiner

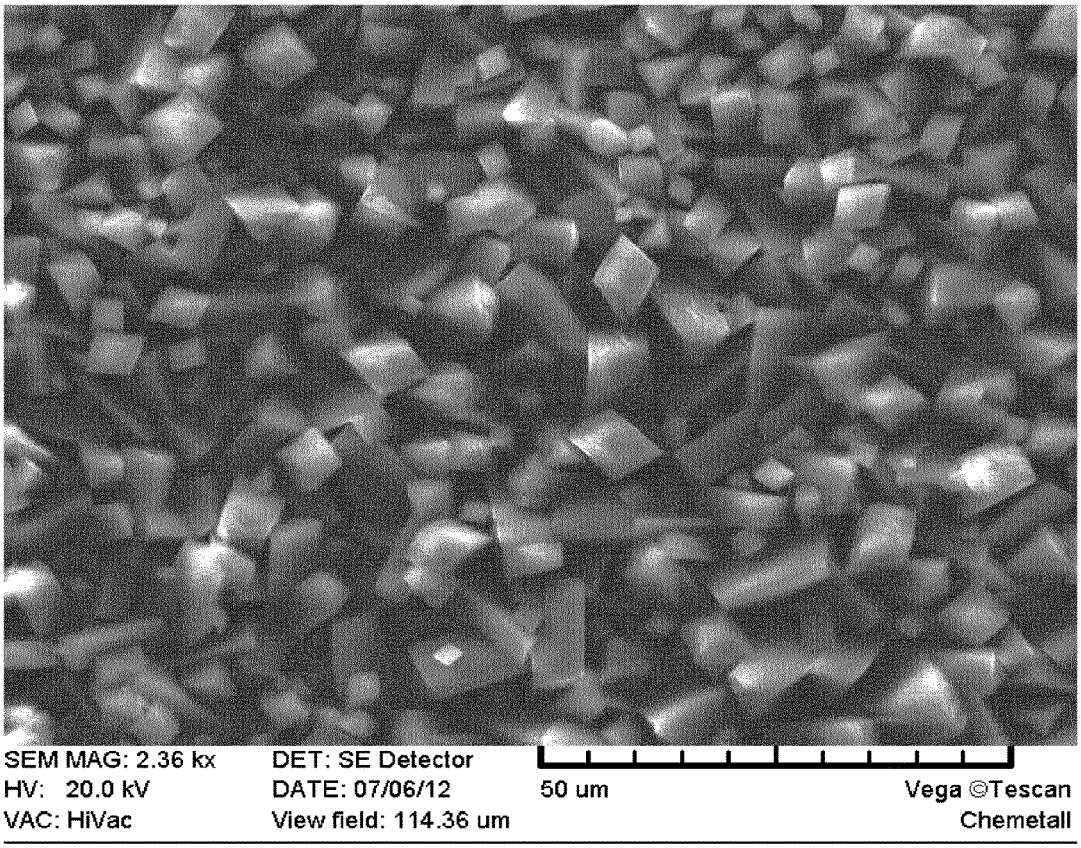
SEM MAG: 2.36 kx
HV: 20.0 kV
VAC: HiVac
DET: SE Detector
DATE: 07/06/12
View field: 114.36 um
50 um
Vega ©Tescan
Chemetall

METHOD FOR PREPARING SHAPED METAL BODIES FOR COLD WORKING

REFERENCE TO RELATED APPLICATIONS

This is a National Stage entry of International Patent Application PCT/EP2014/072191, filed on Oct. 16, 2014, which application claims priority from German Application No. 102013221107.4, filed Oct. 17, 2013. Each patent application identified above is incorporated herein by reference in its entirety.

BACKGROUND

The invention relates to a method for coating shaped metal bodies first with an aqueous acidic oxalating solution and, if necessary, next with a lubricant composition in particular in the form of an aqueous solution or dispersion based on organic polymer(s)/copolymer(s), an oil emulsion, an oil, a solid lubricant or a dry lubricant such as soap powder to prepare the metallic shaped body for cold forming.

A cold forming may take place typically at surface temperatures up to about 450° C. without external heat supply. The heating can thus occur solely due to the frictional forces between the coated metallic shaped body blank and the tools in effect during the reshaping and due to internal frictional forces caused by material flow, however where necessary also by preheating the shaped body to be reshaped. However, usually the temperature of the shaped body to be reshaped begins often at environmental temperature, thus at approximately 10 to 32° C. But if the shaped body to be reshaped is pre-heated to temperatures in the range, for example, from 650 to 850° C., from 850 to 1250° C. or from 650 to 1250° C., medium temperature forming or forging occurs. In addition, during the cold forming step high pressure increase usually occurs, e.g. for steel in the range of 200 MPa to 1 GPa and partially even to 2 GPa.

As shaped bodies to be reshaped, most often strips, sheets, slugs, wires, wire coils, intricately formed shaped parts, sleeves, profiles such as hollow- or solid profiles, pipes, round blanks, discs, rods, bars and/or cylinders are used. A slug is a disc or a section of a wire, of a wire coil or of a bar.

The metallic shaped body to be cold-reshaped can basically consist of any metallic material. Preferably it is essentially composed of steel, aluminum, aluminum-alloy, copper, copper-alloy, magnesium-alloy, titanium, titanium-alloy, in particular structural steel, high-tensile steel, stainless steel, iron- or steel material with chrome content and/or metal-coated steel such as aluminized or galvanized steel. Most often the shaped body is substantially made of steel.

While forming oils are normally used in the cold forming of metallic shaped bodies having lower degrees of forming and corresponding lower strengths, at much higher degrees of forming as a rule at least one coating is used as separation layer between shaped body and tool in order to prevent a cold welding of shaped body and tool. In the latter case, it is conventional to provide the shaped body with at least one coating of a lubricant or with a lubricant composition to reduce the frictional resistance between the surface of the shaped body and the shaping tool.

The cold forming comprises above all:

- a slip-type drawing (push-pull forming), for example of welded or seamless pipes, hollow profiles, solid sections, wires or bars such as in wire drawing or tube drawing, for example,

- a flow turning, wall-ironing (reshaping to final dimension) and/or deep drawing, for example of strips or sheets into especially deep-drawn shaped bodies or of hollow bodies into strongly deformed hollow bodies,
- a roll threading and/or thread tapping, e.g. in the case of nut- or screw blanks,
- a pressing, such as e.g. cold extrusion (pressure forming), e.g. of hollow or solid bodies or extrusion methods, and/or
- a cold forging, e.g. of wire sections into connecting elements, for example nut- or screw blanks.

Earlier, metallic shaped bodies were almost only prepared for cold forming either by applying a fat, an oil or an oil emulsion. For a long time, a lubricating layer usually followed on a separating layer, to minimize the friction occurring during the reshaping. In so doing, the blanks usually are first coated with zinc phosphate to form a separating layer and then either with a soap in particular based on alkali- and/or alkaline earth stearate and/or with a solid lubricant in particular based on molybdenum sulfide and/or carbon to form a lubricating layer, before the thus-coated blanks are cold formed.

The aforementioned lubricating system of the state of the art is mainly built up on zinc phosphate as separating layer. Here, however, the conditions of environmental compatibility and industrial hygiene as well as the requirements for safety-relevant components of phosphate-free and of low-in-heavy-metals baths and coatings are considered much more strongly today than in the past.

The metallic shaped bodies to be cold formed are pre-coated prior to the cold forming. During the preparation for cold forming, the metallic surface of the shaped body or the metallically coated coating thereof can be provided with a conversion coating, in particular be oxalated or phosphated. The conversion coating can preferably take place using an aqueous composition based on oxalate, alkali phosphate, calcium phosphate, magnesium phosphate, manganese phosphate, zinc phosphate or related mixed crystal phosphates, such as e.g. ZnCa-phosphate. Sometimes the metallic shaped bodies are coatless, i.e. without a prior conversion coating, but wetted with a lubricant composition. However, the latter is only possible when the metallic surface of the shaped body to be reshaped is chemically and/or physically cleaned beforehand.

In the following, the steels usable according to the invention will be characterized as such, which have a carbon content in the range of 0 to 2.06 wt. % and thus are not part of the iron-materials, and as such, have a chrome content in the range of 0 to <10 wt. % and in particular in the range of 0.01 to 9 wt. %, of 0.05 to 8 wt. %, of 0.1 to 7, of 0.2 to 5 wt. %, of 0.25 to 4 wt. % or of 0.3 to 2.5 wt. %. These include on the one hand according to DIN EN 10025 so-called structural steel, unalloyed steel, unalloyed quality steel, unalloyed stainless steel, microalloyed steel, low alloy steel and high alloy steel, and on the other hand, also case-hardened steel according to DIN EN 10084 and heat-treatable steel according to DIN EN 10083. These steels are designated hereinafter as "usable according to the invention" or as "not corrosion-resistant" if they have within the scope of this invention a chrome content of less than 10 wt. %. In comparison to these steels, which basically are cold-formable, cast iron is nevertheless not cold-formable.

Steels have carbon content in the range of 0 to 2.06 wt. %. Of the various element contents of steel, the chrome content of the steel above all influences the pickling attack of an acidic aqueous oxalating composition and also of an acidic aqueous zinc phosphating composition. Then when the chrome content is clearly under 10 wt. %, a passivating layer forms on the steel, which protects the steel from oxidation and chemical attack. Thus, in this way the pickling attack on the substrate is hindered or completely inhibited, and a separating layer is not formed, because no iron can be etched out from the substrate.

In order to form separating layers on steels having a chrome content >10 wt. %, it is conventional to coat these components with an oxalating layer with the aid of an aqueous halogen- and thiosulphate-containing oxalating solution. The oxalating solution so activated makes possible a drastically higher pickling attack than an aqueous halogen- and thiosulphate-free oxalating solution. As has now been found, the oxalating solutions of the prior art lack a capability to reduce the pickling attack with sufficient formation at the same time of an adhesive oxalate layer. Therefore, up to now no steels having a carbon content in the range of 0 to 2.06 wt. % and a chrome content in the range of 0 to <10 wt. % could be coated with oxalate layers. Therefore, such steels were coated at greater expense and with more-polluting and altogether more expensive zinc phosphate coatings, while only steels having chrome content of <5 wt. % can be zinc phosphated.

A stronger pickling attack results overall in the coating of steel-blanks having a carbon content in the range of 0 to 2.06 wt. % and a chrome content in the range of 0 to <10 wt. % with aqueous oxalating containing e.g. thiosulphate and/or halogen compound, so that an inadequate, namely a too-thin and unclosed separating layer or even no separating layer at all is formed. These oxalate layers were completely unsuitable for a cold forming.

the pickling attack is not so high, which is advantageous for the structure of the oxalate layer and in which highly suitable oxalate layers were applied as separating layers for the cold forming.

Because it now was shown, that with the coating of steel-blanks having a carbon content in the range of 0 to 2.06 wt. % and a chrome content in the range of 0 to <10 wt. % with aqueous oxalating compositions without a content of sulfur compounds such as thiosulfate and without a content of halogen compound, a pickling attack advantageous for the structure of the oxalate layer results, so that oxalate layers well-suited as separating layers for the cold forming are formed.

In the coating of steel-blanks having a chrome content of clearly more than 10 wt. % with aqueous oxalating compositions having a content e.g. of thiosulfate and/or halogen compound, an advantageous pickling attack resulted, which also corrodes the passivating layer formed by this high chrome content, so that good oxalate layers were formed due to the very strong pickling attack. These oxalate layers were also well-suited for a cold forming.

Conversely, it surprisingly was also revealed that during the coating of steel-blanks having a chrome content of clearly more than 10 wt. % with aqueous oxalating compositions without a content of sulfate such as e.g. thiosulfate and without a content of halogen compound, a too-low or even no pickling erosion at all results, so that no oxalate layers suitable as separating layers for the cold forming are formed.

These conditions are clearly exemplified below in Table 1, wherein the material of sheet A is a cold-rolled steel CRS and wherein the material of slug B is denoted by 1.0401 and that of sheet C by 1.4571:

| Contents in g/L | VB1 | VB2 | VB4 | B5 | B6 | VB8 |
|---|---|---|---|---|---|---|
| Blank | Sheet A | Slug B | Sheet C | Sheet A | Slug B | Sheet C |
| Steel material | CRS | C15 | X6CrNiMoTi17-12-2 | CRS | C15 | X6CrNiMoTi17-12-2 |
| C-content in wt. % | 0.039 | 0.12-0.18 | 0.08 | 0.039 | 0.12-0.18 | 0.08 |
| Cr-content in wt. % | 0 | 0 | 17 | 0 | 0 | 17 |
| Oxalic acid | 54.0 | 54.0 | 54.0 | 40.0 | 40.0 | 40.0 |
| Nitroguanidine | | | | 0.4 | 0.4 | 0.4 |
| Sodium thiosulfate | 1.6 | 1.6 | 1.6 | | | |
| Sodium chloride | 25.0 | 25.0 | 25.0 | | | |
| Sodium fluoride | 0.2 | 0.2 | 0.2 | | | |
| Sodium hydrogen fluoride | 10.0 | 10.0 | 10.0 | | | |
| Thickening agent 1 PEG 400 | | | | 10 | 10 | 10 |
| Total acid TA points | 70 | 70 | 70 | 60 | 60 | 60 |
| Bath temp. ° C./contact time min | 65/3 | 65/3 | 65/3 | 65/3 | 65/3 | 65/3 |
| Pickling removal PR g/m$^2$ | 2.3 | 2.5 | 4.3 | 2.1 | 2.1 | 0 |
| Layer weight LW g/m$^2$ | 1.6 | 1.4 | 7.6 | 5.3 | 4.9 | 0 |
| Ratio PR/LW % | 143.8 | 178.6 | 56.6 | 39.6 | 42.9 | — |
| Oxalate layer quality | very poor | very poor | good | very good | very good | no layer |
| Lubricant layer | polymer | polymer | polymer | polymer | polymer | polymer |
| Lubricant layer thickness g/m$^2$ | 1.7 | 1.7 | 1.7 | 1.6 | 1.8 | 1.7 |
| Lubricant layer quality | good | good | good | good | good | good |
| Cold forming | not possible | not possible | good | very good | very good | not possible |
| Disadvantages? | non-adhering and unclosed oxalate layer, thus cold forming not possible | | cold forming possible only of chrome-alloyed steel >10% Cr | none | | missing oxalate layer, thus no cold forming possible |

BRIEF DESCRIPTION OF THE DRAWINGS

FIG. 1 depicts a typical example of a crystalline iron oxalate layer.

DETAILED DESCRIPTION

Surprisingly, a method has now been found to oxalate these so-called non-corrosion-resistant steels, with which The table makes clear the strong dependence of the cold formability and the quality of the cold forming on the presence and the quality of the oxalate layer. Gardomer® based on organic polymer/copolymer was used here, which is preeminently suitable as a lubricant layer for cold forming and has a very wide effectiveness.

In the comparative examples VB1 und VB2, the ratio of pickling attack to layer weight is much too high, so that exceedingly thin oxalate layers were formed, which produced no closed and no adherent layers. In comparative example VB5 the passivating layer on the high chrome-containing layer is not corroded, so that no pickling occurred, no pickling removal took place and the oxalate layer formation remained undone.

In comparative example VB3, the pickling attack is so strong that it dissolves the passivating layer on the high chrome-containing steel, so that the pickling removal, the layer weight and the ratio PR to CW are of suitable strength, thereby a good oxalate layer is formed, which enables a good cold forming.

In examples B1 und B2 according to the invention, very good oxalate layers result due to the excellent bath formulation, which are very well suited for the cold forming.

With these steels usable according to the invention having a chrome content less than 10 wt. %, the phosphating to date is the usual treatment to form a separating layer. However, the phosphating has the considerable disadvantage for the material properties of critical components, where e.g. precise material properties are adjusted by heat treatment, that phosphates are contained. Namely because phosphorus diffuses during a heat treatment from the metallic surface into the steel microstructure and the phosphorus content damages the properties of such steels, in particular by delta-ferrite-formation, sensitivity against mechanical impact and embrittlement. As a result of phosphorus-induced embrittlement, critical components are unusable, since notched impact strength, brittleness etc. are impaired. Phosphorus in the smallest content already raises the sensitivity against temper embrittlement and causes cold brittleness and brittle fracture. Therefore, critical components such as e.g. screws and other joining elements must be cleaned very carefully and expensively after phosphating. A residual phosphate content can hardly be avoided. A metallographically detectable phosphorus is not permissible according to EN ISO 898. Thus, it would be advantageous to utilize a phosphate-free treatment method as the preparation for the cold forming, but that is not known with detailed appreciation in the prior art. Also, a contact of these steels with sulfur impairs the material properties.

For these steels usable according to the invention, no heavy metal-free and simultaneously largely environmentally-friendly method for cold forming preparation is known to the expert applicant. In fact, for several decades there has been a need for a phosphate-free and as far-reaching as possible environmentally-friendly method to prepare the non-corrosion-resistant steels for cold forming, as is suggested in the textbook of Kurt Lange: *Umformtechnik* [Forming Technology], Vol. 1 p. 258 $2^{nd}$ Ed. 1984 and Vol. 2 p. 661 $2^{nd}$ Ed. 1988. The oxalation has not proven itself to be different than the phosphating with the steels usable according to the invention, since the coatings in comparison to the phosphating are not sufficiently adherent and thus are not suitable for the application purpose. Nearly all oxalating solutions of the prior art contain, in addition to water, a content of bromide, chloride, chlorate, fluoride, nitrite and/or sulfur compound in order to produce adherent coatings.

It now appeared that the oxalating solutions and oxalating layers of the prior art are suitable only for corrosion-resistant steels including stainless steels having a chrome content of clearly more than 10 wt. %, since they only form layers suited for the cold forming on these types of steel. The halogen and sulfur compounds are therefore undesirable, because they are environmentally unfriendly and also partially toxic and also optionally cause strong corrosion advancement. Contents of heavy metals apart from iron and zinc should be avoided as much as possible, because they are mostly environmentally unfriendly, adversely affect the work hygiene and cause disposal problems and high additional costs. They are thus to be identified according to the ordinance on hazardous substances.

DE 976692 B discloses the use of oxalating solutions having a content of 1 to 200 g/L oxalic acid, of 0.2 to 50 g/L iron chlorides, of 5 to 50 g/L phosphate calculated as $P_2O_5$ and optionally of Cr- or Ni-salt.

U.S. Pat. No. 2,550,660 describes the addition of oxygen-containing sulfur compounds such as sodium and of halogen compounds such as sodium chloride and ammonium bifluoride, which increase the attack of oxalic acid solutions on rust-free steel and thus form oxalate layers with lower contents of activators.

The oxalation of metallic surfaces is also known for purposes of corrosion protection and where necessary also for improvement of paint adhesion. The oxalate layers, however, as a result of the halogenide content have proven to be so less corrosion-protective and so less adherent compared to zinc phosphate layers, that already for decades oxalation is no longer used for corrosion protection. The sole exception is for formation of the separating layer for the cold forming of corrosion-resistant steels having clearly more than 10 wt. % chrome-content.

The oxalation makes possible the formation of a completely phosphate-free separating layer without use of environmentally unfriendly heavy metals. Iron and zinc are not considered in the sense of this application as environmentally unfriendly cations or heavy metals. However, use of oxalation according to the prior art causes undesired corrosion and very poorly adherent layers due to the halogen- and/or sulfur compounds used on non-corrosive-resistant steels having a chrome content of less than 10 wt. %, and the layers are not suited for cold forming, because they have no reliably functional separating layer for the cold forming.

Surprisingly, it was now discovered that the environmentally unfriendly additives and also those disadvantageous for the preparation process, that are and were used repeatedly in the oxalations of the prior art, are not necessary for the preparation of non-corrosion-resistant steels for the cold forming.

Further, it has now surprisingly been found, that the sludge unpreventably attacking in the tank is held in markedly lower weight, that the sludge can be kept free from heavy metals with exception of iron, zinc and steel stabilizers etched out from the steel and thus is processed more easily, cost effectively and with more environment friendliness than with the other applied phosphatings. Because approximately 3 tons of dried sludge arises for the coating according to the method of the invention of 50,000 tons of steel wire of 9 mm diameter, while with various types of zinc phosphating processes approximately 14 to 48 tons dried sludge results, depending on process variants.

With the various metallic materials, from which shaped bodies should advantageously be formed by cold forming, it is apparent that in the case of shaped bodies made of steel having a chrome content in the range of 0 to less than 10 wt-%, a special need exists for a suitable preparation for the cold forming, which can be achieved with phosphate-free oxalation.

The object consisted of proposing a method to treat shaped bodies with an iron- or steel surface having a chrome content in the range of 0 to <10 wt. % with a conversion treatment prior to cold forming, which works substantially or totally phosphate-free and wherein the addition of environmentally unfriendly heavy metals can be foregone.

The object is achieved with a method for treatment of shaped bodies with a steel surface having a carbon content in the range of 0 to 2.06 wt. % and having a chrome content in the range of 0 to <10 wt. % in particular prior to a cold forming, wherein these steel surfaces optionally can also be galvanized or alloy-galvanized, which is characterized in that at least one shaped body is contacted with an aqueous acid composition (=bath of the conversion composition) to form a conversion layer as separating layer, that the aqueous acidic composition is provided only in a formulation, which consists essentially of water, 2 to 500 g/L oxalic acid calculated as anhydrous oxalic acid and a) 0.01 to 20 g/L of at least one catalyst based on guanidine calculated as nitroguanidine and/or b) 0.01 to 20 g/L of at least one nitrate calculated as sodium nitrate and optionally of at least one thickening agent based on at least one compound of polyacrylamide, polyallylamine, polyethylene glycol, polysaccharide, polysiloxane, polyvinylamide and/or polyvinylamine, and optionally of a pigment for the free-flowability of the oxalic acid and optionally of at least one surfactant and optionally is additionally formulated with a supplementation thereof, which consists essentially only of at least one of the components of the formulation, that the conversion layer is optionally dried, that the pickling removal of the aqueous acidic composition is in the range of 1 to 6 g/m$^2$ measured by gravimetric determination according to DIN EN ISO 3892, that the layer weight of a dried conversion layer is in the range of 1.5 to 15 g/m$^2$ measured by gravimetric determination according to DIN EN ISO 3892, that the ratio of pickling erosion to layer weight BA:SG of the dried conversion is in the range of (0.30 to 0.75):1, that the dried conversion layer forms a solid, adherent coating and that optionally a lubricant layer is applied on conversion layer with a lubricant composition and that the lubricant layer is dried.

In the method according to the invention, preferably blanks in the form of sheets, slugs, wires, wire coils, shaped components, profiles, pipes, round blanks, bars and/or cylinders made of a steel material having a carbon content in the range of 0 to 2.06 wt. % and having a chrome content in the range of 0 or 0.001 to <10 wt. % are used. Here it is preferred, that as substrate a strip, sheet, slug, wire, wire coil, complex shaped components, a sleeve, a profile, pipe, a round blank, sheet, rod, a bar and/or a cylinder made of steel material is oxalated prior to the cold forming. The substrate for this may comprise a zinc- or zinc-alloy layer. Usually only galvanized or alloy-galvanized slugs are provided. Optionally, the blanks to be reshaped are initially heat-treated to adjust the material properties, for example by soft annealing, whereby they are put into a good cold formable condition.

When necessary, the surfaces of the blanks to be cold formed and/or the surfaces of the metallic coatings thereof are purified in at least one cleaning process prior to the coating with the aqueous oxalation, whereby basically all cleaning processes are suited for this. The chemical and/or physical cleaning may comprise above all a mechanical descaling, annealing, peeling, rays such as e.g. sand jets, in particular alkaline cleaning agents and/or acidic pickling agents. Preferably the chemical cleaning takes place by degreasing with organic solvents, by cleaning with alkaline and/or acidic cleaning agents, with neutral cleaning agents, with acid pickling agents, and/or by rinsing with water. A pickling agent and/or rays are used above all for descaling of metallic surfaces. For this it is preferable, e.g. to only anneal a welded pipe made of cold strip after the welding and shaving, e.g. to pickle, rinse and neutralize a seamless pipe.

Alternatively or additionally, it is possible for cleaning of the metallic surfaces to also add at least one surfactant present in strong acid such as in particular at least one cationic surfactant such as e.g. a laurylamine polyethylene glycolether such as Marlazin® L 10 and/or a benzalkonium chloride such as Lutensit® TC-KLC 50 of the oxalating composition according to the invention, so that during oxalation the surfaces are also slightly cleaned and/or a cleaning and oxalation is effected in a single pot process. The separate purification step can then be omitted for lightly contaminated parts. The surfactant-addition in the oxalating bath has the advantage, that in a single bath and in a single process step cleaning and oxalation can take place simultaneously, wherein the metallic surface is evenly corroded by the oxalic acid and can be coated better and more uniformly and that the accretion of sludge particles on the oxalate layer can be greatly prevented.

All compositions, which "consist essentially of "certain components, may only "consist" of these components or "contain" these components.

The aqueous conversion layer can optionally be dried separately or at the same time with the subsequently applied lubricant layer, whereby the conversion layer in the latter variant may contain residual water content, in order to avoid a drying step and/or so that the lubricant layer is applied onto a sufficiently adherent and still moist conversion layer. Here it is particularly preferred, that oxalated substrate be coated with a lubricant layer in a wet-on-wet process.

In the method according to the invention, preferably no heavy metal is intentionally added other than iron and in particular no environmentally unfriendly heavy metal is added. As the practice, however, repeatedly shows, optionally contents of iron, zinc, steel stabilizing elements and/or alloy components in the bath for forming the separating layer and optionally also small amounts of impurities of halogen compounds, phosphorus compounds, and/or sulfur compounds from other baths and parts of the equipment are introduced into the bath for forming the separating layer from time to time in some systems.

Water is used as solvent, in particular as deionized water or as municipal water. The water content of the aqueous oxalating composition is preferably 40 to 99.75 wt. % water.

The aqueous acidic composition according to the invention for formation of a conversion layer (=conversion composition bath) is used, in order to form a separating layer on the surface of the metallic blank. This composition and/or the bath is/are prepared only with a formulation, which consists essentially of water, 2 to 500 g/L oxalic acid calculated as anhydrous oxalic acid and a) 0.01 to 20 g/L of at least one catalyst based on guanidine calculated as nitroguanidine and/or b) 0.01 to 20 g/L of at least one nitrate calculated as sodium nitrate and optionally at least one thickening agent based on at least one compound of polyacrylamide, polyallylamine, polyethylene glycol, polysaccharide, polysiloxane, polyvinylamide and/or polyvinylamine in a content in the range of 0.01 to 50 g/L, optionally of a pigment for the flowability of the oxalic acid in a content in the range of 0.01 to 20 g/L and optionally of at least one surfactant, which is stable in the acid composition, in a content in the range of 0.01 to 5 g/L. In further work with this bath, in which certain components of the bath are optionally consumed differently, if necessary, a supplement is added which consists essentially of or only of one of the components of the formulation. Here, oxalic acid is usually consumed most strongly and thus normally has top priority as a supplement. Water must never be added with the supplement of oxalic acid.

The oxalic acid is hereby calculated to be completely dissolved, with g/L being used as unit. The oxalic acid is usually is usually contained stable in water and in the whole bath up to the solubility limit at the respective temperature. Commercially contained oxalic acid frequently is present in the form of course powder and is then optionally finely ground, before it is added to the bath. Here it may be advantageous to add a fine powder to the oxalic acid present in powder form, for example an oxidic or silicate powder in particular having a powder grain size in the range of 0.5 to 20 μm, in order to prevent a caking of the easily hygroscopic powder and to ensure a flowability. The flowable oxalic acid has the advantage that the oxalic acid does not cake and thus is easier to handle. The flowability is of greater significance for better pumping and dosing of the powder. The flowability is thereby ensured, in that a suitable fine-grained pigment surrounds the components and in particular the oxalic acid surrounds and prevents coalescence of neighboring powder particles. Thereby, a clumping of oxalic acid is considerably reduced or entirely prevented. Clumped products cannot be metered and partly are not usable with automatic suction devices. Furthermore, the pulping times of clumped products are much greater.

Thus the aqueous composition may contain 0.001 to 20 g/L of at least one inorganic or organic pigment, preferably pigments based on oxides, organic polymers and/or wax. In particular, titanium powders have worked especially well.

It has been shown, that contents of oxalic acid in the range of 0.5 to 400 g/L can generally be used well in the oxalation. However, particularly high contents of oxalic acid are present only at high temperatures in water. With use of contents in the concentration range around 1 g/L, however, the oxygen content of the aqueous composition has to be supplemented after a short time. The aqueous acidic composition according to the invention for forming a conversion layer and/or the bath itself preferably comprise a content of oxalic acid in the range of 5 to 400 g/L, of 10 to 300 g/L, of 15 to 200 g/L, of 20 to 120 g/L, of 25 to 90 g/L, of 30 to 60 g/L or of 35 to 40 g/L, calculated as anhydrous oxalic acid $C_2H_2O_4$. The dilution factor of a concentrate containing oxalic acid for the bath can preferably lie in the range of 1 to 20 when diluted with water.

Iron oxalate, iron oxalate dihydrate, zinc oxalate, and/or zinc oxalate dihydrate are formed from the oxalic acid during oxalation depending on the composition of the contacted metallic surfaces of the blank due to the etched-off cations.

As catalyst, at least one catalyst based on guanidine and/or at least one nitrate including nitric acid calculated as $NO_3$ can be used. Further catalysts beyond this are not required and often are not useful. Nitrite as catalyst is also a catalyst in the presence of iron oxalate and generates interfering nitrous gases. Chlorate is halogen-containing as catalyst. An m-nitrobenzenesulfonate as the sodium salt SNBS is sulfur-containing as catalyst. Hydrogen peroxide reacts chemically with oxalic acid and does not act as a catalyst. Hydroxylamine compounds as catalysts are suspected of forming carcinogenic nitrosamines. Thiosulfate as catalyst causes a much too strong pickling attack, so that for this reason no oxalate layer is formed.

As catalyst a) based on guanidine, for example aetatoguanidine, aminoguanidine, carbona-toguanidine, iminoguanidine, melanilinoguanidine, nitroguanidine, nitratoguanidine and/or ureidoguanidine are added. Aminoguanidine and nitroguanidine are hereby particularly preferred. In particular, nitroguanidine can contain a stabilizer to reduce the impact-sensitivity, for example a content contained as silicate. Due to a low concentration of nitroguanidine in the aqueous composition and optionally also of a stabilizer additive, an overly fast reaction of the nitroguanidine is definitely avoided. Generally, this stabilizer also functions as a biocide and/or as thickening agent. As catalysts based on nitrate, for example sodium nitrate, potassium nitrate, ammonium nitrate, nitric acid and many other organic and/or inorganic nitrates are used such as e.g. iron nitrate. Especially preferred, however, are sodium nitrate, potassium nitrate and nitric acid.

If only a guanidine compound is used as catalyst, a slightly increased consumption of this catalyst can often be observed. If only nitrate is used as a catalyst, then a somewhat higher concentration of this catalyst is selected. If at least one guanidine compound and at least one nitrate is used as catalyst, then often a definitely lower consumption of guanidine compound and simultaneously a somewhat lower consumption of nitrate can be observed.

The aqueous acidic composition according to the invention for forming a conversion layer and/or the bath itself preferably has/have a total content of catalysts a) and/or b) in the range from 0.05 to 30 g/L, of 0.1 to 20 g/L, of 0.2 to 12 g/L, of 0.25 to 10 g/L, of 0.3 to 8 g/L, of 0.35 to 6 g/L, of 0.4 to 4 g/L, of 0.45 to 3 g/L or of 0.5 to 2 g/L, calculated as sum of the calculated content based on nitroguanidine and sodium nitrate.

The aqueous acidic composition according to the invention for forming a conversion layer and/or the bath itself preferably has a content of guanidine-containing catalysts a) in the range of 0.05 to 18 g/L, of 0.1 to 15 g/L, of 0.2 to 12 g/L, of 0.3 to 10 g/L, of 0.4 to 8 g/L, of 0.5 to 6 g/L, of 0.6 to 5 g/L, of 0.7 to 4 g/L, of 0.8 to 3 g/L, of 0.9 to 2.5 g/L or of 1 to 2 g/L, calculated as mitroguanidine $CH_4N_4O_2$.

The aqueous acidic composition according to the invention for forming a conversion layer and/or the bath itself preferably has/have a total content of nitrate-containing catalysts b) in the range of 0.05 to 18 g/L, of 0.1 to 15 g/L, of 0.2 to 12 g/L, of 0.25 to 10 g/L, of 0.3 to 8 g/L, of 0.35 to 6 g/L, of 0.4 to 4 g/L, of 0.45 to 3 g/L of 0.5 to 2 g/L, calculated as sodium nitrate $NaNO_3$.

The ratio of the concentrations in g/L of oxalic acid calculated as anhydrous oxalic acid to the totality of catalysts a) and b) calculated as nitroguanidine and/or sodium nitrate, of which at least one catalyst is present, in the aqueous acidic composition according to the invention for forming a conversion layer and/or the bath itself is preferably in the range of 500:1 to 2:1, of 150:1 to 5:1, of 80:1 to 8:1, of 40:1 of 10:1 of 20:1 to 12:1.

When the content of at least one catalyst in the bath is too low or even is absent, a disturbance or even a cessation of the layer formation may occur. When the content of the at least one catalyst in the bath is too high, an unnecessary high consumption of catalyst(s) may occur.

A thickening agent can help to adjust the viscosity of the bath, to influence the formation of the wet film and to reduce the corrosion of the surface of the blank. When no thickening agent is used, the formation of the wet film can be considerably less than with a thickening agent and the drying of the wet film can take place faster than with a thickening agent. If the content of a thickening agent in the bath is too high, it may happen that the wet film dries only very slowly. The thickening agent should be stable in the bath. The thickening agent can be added in the formulation and also in the running operation of the bath.

With the at least one thickening agent, a viscosity of the bath is preferably adjusted approximately in the range of 0.2 to 5 mPa·s measured at 20° C. with a rotational viscometer. The thickening agent according to the invention is preferably a polysaccharide such as e.g. one based on cellulose or xanthan and/or a polyethylene glycol, in particular a polyethylene glycol with an average molecular weight in the range of 50 to 2000 or of 200 to 700.

The at least one thickening agent is preferably used in a content of 0 or in the range of 0.01 to 50 g/L in the aqueous acidic composition according to the invention for forming a conversion layer and or in the bath itself, particularly preferably in a content in the range of 0.1 to 50 g/L, of 1 to 45 g/L, of 2 to 40 g/L, of 3 to 30 g/L, of 4 to 25 g/L or of 5 to 20 g/L, calculated as completely dissolved material and/or as completely dissolved thickening agent in the bath.

The treatment bath may be formulated with a liquid aqueous concentrate, which is produced by dissolving a predetermined amount of oxalic acid and optionally also by adding catalyst, pigment, surfactant and/or thickening agent in demineralized water. The dilution factor for the dilution of a concentrate for the bath formulation can be maintained in the range of 1 to 100.

As an alternative to this, the treatment bath can be formulated with a powdery concentrate, which is produced by kneading, grinding, blending and/or rubbing of powdered oxalic acid and optionally by addition of nitrate dissolved in water, pigment for raising the flowability, surfactant and/or thickening agent, for example in a kneader and/or mixer. The factor for the dissolution of the concentrate in water for the bath formulation can be maintained in the range of 1 to 100.

In another alternative, the treatment bath can be formulated with a paste-like concentrate, which is produced, for example in a kneader and/or mixer by mixing oxalic acid with water and optionally by adding at least one catalyst dissolved in water, pigment to raise the flowability, a surfactant and/or thickening agent. It may have a water content of up to about 10 wt. %. This concentrate can be adjusted to a paste-like meterability and slightly soluble product. The dilution factor for diluting this concentrate to the bath formulation can be in the range of 1 to 100.

All types of concentrate have proved effective and provided well-usable bath formulations. The powdery concentrates are particularly advantageous in manufacture and in transport. The highly concentrated paste has the advantage of consisting of one component and is easy to handle.

However, in the event that a pickling inhibitor such as e.g. a thiourea or tribenzyl amine were to be added to the oxalating composition, the pickling attack and the layer formation would be clearly lowered or entirely prevented. Therefore no minor addition of a pickling inhibitor should also be added in the method according to the invention, but rather the starting solution and the supplement solutions should usually consist only of the components stated in the main claim.

The pH-value of the aqueous acidic composition for formation of the conversion layer is usually in the range of 0 to 3 or of 0.2 to 2.

The aqueous acidic bath composition for formation of a conversion layer as separating layer, the oxalate bath, preferably has a total acid TA in the range of 3 to 870 points. The total acid is measured as follows:

The total acid TA (TA=Total Acid) is the sum of the cations contained and also free and bonded acids. The acids are oxalic acid and optionally nitric acid. The TA is determined by the consumption of 0.1 molar sodium hydroxide using the indicator phenolphthalein in 10 ml oxalating composition diluted with 50 ml demineralized water. This consumption of 0.1 M NaOH in ml corresponds to the point score of the total acid. When another acid appears in the oxalating composition in addition to oxalic acid, the content of the further acid can be separately determined and deducted from the determined total acid, in order to maintain the TA value only with reference to the oxalic acid.

In the method according to the invention the content of total acid can refer only to oxalic acid preferably in the range of 3 to 900 points, of 8 to 800 points, of 12 to 600 points, of 20 to 400 points, of 30 to 200 points, of 40 to 100 points or of 50 to 70 points.

The contact time of a metallic surface of a blank during immersion is preferably in the range of 0.5 to 30 min, in particular in the range of 1 to 20 min, of 1.5 to 15 min, of 2 to 10 min or of 3 to 5 min. The contact time of a metallic surface of a blank during spraying is preferably in the range of 1 to 90 sec, in particular, in the range of 5 to 60 sec or of 10 to 30 sec.

Preferably the blank is contacted by sprinkling, spraying and/or immersion at a temperature of 10 to 90° C. with the oxalating composition. The bath temperature of the oxalating bath is preferably in the range of environmental temperature up to about 90° C., thus approximately in the range of 10 to 90° C., in particular in the range of 25 to 80° C., of 40 to 70° C. or of 50 to 65° C.

When the aqueous acidic bath composition for formation of a conversion layer contacts the metallic surface a pickling effect occurs, whereby a part of the metallic surface is stripped off. The pickling weight loss WL is thereby often in the range of 1 to 6 g/m$^2$, preferably in the range of 1.3 to 4.5 g/m$^2$ or of 1.5 to 3 g/m$^2$. It is determined by weighing the dried coated substrate before and after the coating process. Here it may be desirable to adjust for the lowest possible pickling removal, in order to also generate as little sludge as possible, in particular based on iron oxalate, which is to be disposed of. Otherwise it may be advantageous to adjust the pickling removal on the substrate and also equipment conditions, so that slight scale residue, among other things, is also stripped off the substrate.

The aqueous solution or dispersion of the bath prepared with the starting formulation and optionally also with at least one supplement is preferably with respect to the added components substantially or completely free of heavy metals, substantially or completely halogen-free, substantially or completely sulfur-free and substantially or completely phosphate-free, but may occasionally contain up to about 0.001 g/L $PO_4$. Work in industrial practice demonstrates, however, time and again, that at least temporarily in some baths undesired contents also slip in in small quantities or traces in particular of halogen-, phosphorus-, sulfur- and/or in particular of environmentally unfriendly heavy metal compounds mainly from previous baths, lines and other equipment parts. Preferably the direction of work is, that these contaminations are so minor, that they do not interfere with the running oxalation process and due to the small amounts or traces are diluted more quickly and avoided, if possible. The additives and impurities of the starting formulation or bath are further found at least partially also in correspondingly low levels in the oxalate layer.

During the coating of the steel surfaces, in particular of blanks with the oxalation composition according to the invention, the chemical elements of the steel surface are etched-out in part and taken up in the aqueous solution or dispersion. Thus, this can cause iron and further elements such as e.g. the steel stabilizing elements and other alloy elements such as e.g. chrome, nickel, cobalt, copper, manganese, molybdenum, niobium, vanadium, wolfram and zinc and/or ions thereof to accumulate over time in the bath. However, these elements and/or ions form no precipitation products that sink and form sludge, but precipitate as oxalates. The precipitated oxalates and oxalate dihydrates form an easily removable and environmentally friendly sludge as compared to phosphates, whereas compared to phosphating, the sludge in oxalations precipitates in lower quantities than in the case of phosphating. A part of these elements and/or ions is incorporated as a part of the additives and contaminations of the baths in the oxalate layer. Thus the bath can accept over a longer time an iron content of up to 0.5 g/L or even up to about 1 g/L.

Preferably, the bath composition for oxalating and/or the oxalation layer consists/consist essentially only of oxalic acid, guanidine compounds, nitrates and/or their derivatives and optionally of pigment, surfactant and/or thickening agent and is mainly or completely free from halogen compounds, phosphorus compounds, sulfur compounds and/or heavy metals other than iron and zinc. It is preferred, therefore, that to the starting solution and/or the supplement solutions no compound based on aluminum, boron, halogens, copper, manganese, molybdenum, phosphorus, sulfur, tungsten, carboxylic acids other than oxalic acid, amines, nitrites and/or derivatives thereof is added to the starting solution and/or the supplement solutions—optionally with exception of polyallylamines and/or polyvinylamines, as thickening agents.

Care must be taken with a longer running oxalation, that the bath components are regularly supplemented and that the bath volume is kept almost constant.

The oxalate layer produced according to the invention may, if necessary, be dried, optionally slightly surface-dried or also be further coated wet. In the case of drying, for example a drying with hot air at a temperature e.g. in the range of 80 to 120° C. is recommended.

The oxalated and optionally also lubricant-layer-coated substrates are formed in particular by slip-type drawing such as e.g. with wire drawing or tube drawing, by cold massive forming, flow turning, wall-ironing, deep-drawing, cold extrusion, roll threading, thread tapping, pressing and/or cold heading.

The metallic shaped bodies coated with an oxalated layer according to the invention are preferably dried with a lubricant composition before the coating, when the lubricant composition consists essentially of oil, for example forming oil. With water-based lubricant compositions a drying of the oxalate layer is not required, even if it is still dried in some process runs.

The oxalate layer according to the invention predominantly or preferably consists essentially of iron(II)oxalate, iron(II)oxalate dihydrate and/or other oxalates. Preferably the layer contains no halogen compounds, no phosphorus compounds and/or no sulfur compounds. Preferably the layer contains only traces or even no environmentally unfriendly metals. The iron oxalates are usually crystalline. FIG. 1 depicts a typical example of a crystalline iron oxalate layer. The oxalate crystals often have an average crystal size in the range of 3 to 12 μm. The oxalate layer usually appears light-grey, greenish-yellow and/or greenish-grey.

It is helpful here, if the dried conversion layer is closed to at least 90 area percent or even to at least 95 area percent and is supported with the strongest adherence possible on the metallic surface. The cohesion can be roughly estimated by means of scanning electron microscopic images, wherein a higher resolution should be used to identify pores and access paths to the metallic surface.

The layer weight of the dried oxalate layer is preferably in the range of 1.5 to 15 g/m$^2$, in particular in the range of 3 to 12 g/m$^2$, of 4 to 10 g/m$^2$ or of 5 to 7 g/m$^2$.

The ratio of pickling removal to layer weight PR:LW of the dried conversion layer is preferably in the range of (0.35 to 0.70):1, of (0.36 to 0.55):1 or of (0.37 to 0.45):1.

The layer thickness of the oxalate layer is preferably in the range of 0.1 to 6 μm and in particular in the range of 0.5 to 4 μm, of 1 to 3 μm, of 1.5 to 2.5 μm or is at about 2 μm. The preferred oxalate layer thickness may vary somewhat depending on the type of shaped body. In the case of exacting shaped bodies and/or exacting degrees of forming, the thickness is preferably somewhat greater, i.e. for example about 4 μm instead of about 2 μm.

The lubricant composition may be composed very differently. It may be composed, for example, on the following basis:

1) A salt lubricant carrier composition comprising a content of oil such as e.g. mineral oil, animal oil and/or vegetable oil, derivatives thereof and/or distillates thereof and having a content of respectively at least one boron compound, a metasilicate, a hydrogen phosphate and/or lime, in particular for wires and wire coils in wire drawing;
2) A salt lubricant carrier composition comprising a content of soap(s) based on alkali- and/or alkaline earth metals and having a content of respectively at least one boron compound, a metasilicate, a hydrogen phosphate and/or lime, in particular for wires and wire coils in wire drawing;
3) A salt lubricant carrier composition comprising a content of organic polymer and/or copolymer and having a content of respectively at least one boron compound, a metasilicate, a hydrogen phosphate, and/or lime and with or without a content of soap(s) based on alkali- and/or alkaline earth metals, in particular for wires and wire coils in wire drawing.
1) A salt lubricant carrier composition comprising a content of soap(s) based on alkali- and/or alkaline earth metals, in particular for wires in wire drawing;
2) A composition substantially based on oil such as e.g. mineral oil, animal and/or vegetable oil, derivatives thereof and/or distillates thereof and optionally having respectively at least one EP-additive (extreme pressure), AW-additive (anti-wear for wear protection) and/or VI-additive (viscosity index), in particular for wire drawing, cold massive forming, tube drawing and/or deep drawing;
1) A composition having a content of at least one solid lubricant such as e.g. graphite, molybdenum sulfide and/or tungsten disulfide and optionally a content of respectively at least one organic polymer, organic copolymer and/or wax, in particular for a cold massive forming;
2) A composition essentially based on organic polymer/copolymer and optionally wax such as e.g. products of Chemetall GmbH under the trademark Gardomer®, for all types of cold forming; or
3) A composition essentially based on at least one wax, for all types of cold forming.

The lubricant compositions 6.) to 8.) are also suitable for the most severe cold forming processes.

The lubricant layer is particularly preferably prepared with a lubricant composition, which contains the soap, oil and/or organic polymer and/or copolymer. Preferably, the lubricant composition used in the method according to the invention contains a soap, which chemically corrodes the conversion layer. This chemical attack on the oxalate layer refers in particular to a noteworthy attack or even to an attack of at least 15 wt. % based on the thereby occurring stripping-off and/or reaction of the oxalate layer, whereby the oxalate layer is partially dissolved and/or partially reacted into iron hydroxide, iron stearate and/or oxalic acid.

The metallic shaped bodies are preferably completely dried-off after coating with the lubricant composition, in particular with warm air or radiant heat. This is often necessary, because water content in surface coatings as a rule may interfere with cold forming, and otherwise the surface coating may be insufficiently formed and/or a surface coating of inferior quality may be formed. Also because vapor bubbles, surface defects or defects may occur in forming. Thereby, as a general rule, a rusting may also occur, which can be prevented or reduced, however, with oxalate layers that are closed to the greatest extent possible, and quick further treatment with a lubricant composition, for example one based on or having a content of oil. The rapid drying of the oxalate layer, e.g. with hot air is recommended, if longer standing times until the coating are expected.

The lubricant layer according to the invention preferably comprises after the drying a layer thickness in the range of 0.01 to 40 μm, which is preferably formed thinner or thicker, depending on the type of lubricant composition. The average dry layer thickness thereof is particularly preferably in the range of 0.03 to 30 μm, of 0.1 to 15 μm, of 0.5 to 10 μm, of 1 to 5 μm or of 1.5 to 4 μm. Furthermore, the average dry layer thickness of the lubricant layer increases, depending on which base composition is selected, wherein the lubricant layers of lubricant layer 5.) are usually the thinnest.

It has been shown, that the best results in cold forming are achieved with lubricant compositions, which comprise a content of at least 5 wt. % of organic polymers and/or copolymers, for example products of Chemetall GmbH under the trade names Gardomer®. They show an optimal compatibility of the layers with the oxalate layer, also because they do not chemically attack the oxalate layer, and give the best forming results in the tests on oxalate layers. Also because they can be used excellently in all types of cold forming together with an oxalate layer according to the invention. In addition, these coatings do not require replacement when changeover is made to other types of blanks and/or other types of cold forming.

Comparison with cold formings of coated steels with a zinc phosphate layer of the prior art and with a lubricant layer, demonstrated that the oxalate layers according to the invention can be kept thinner than the zinc phosphate layers of the prior art, so that despite equivalent performance during cold forming, a lower chemical consumption occurs, which markedly reduces the operating costs. In addition, the oxalate layers according to the invention are phosphate-free. The sludge and waste water of the oxalating process according to the invention are hardly or not at all loaded with environmentally unfriendly heavy metals, environmentally unfriendly phosphates and/or environmentally unfriendly additives, so that compared to the zinc phosphating and also to oxalating according to the prior art a simpler and significantly more cost-effective processing and disposal of the sludge and waste water is possible.

The case of intricately formed blanks, for example profiles or connecting elements such as screws and bolts, which were cold formed by ironing or by a single- or multistep profile path or forging and wire pull, showed that the oxalate layer according to the invention has a great capacity in cold forming. This was also demonstrated in ironing operations and extrusion of slugs to intricately formed parts such as e.g. cones or tripods.

The oxalated and optionally also lubricant-layer coated blanks can be cold formed in particular by deforming, cold massive forming, pressing, beating, rolling and/or drawing.

The cold formed substrate may be used as construction- or connecting elements, as sheets, wires, wire coils, intricately formed parts, sleeves, profile elements, tubular elements, e.g. as welded seamless pipes, cylinders and/or as components in particular in energy technology, vehicle manufacture, apparatus- or mechanical engineering.

Surprising Effects and Advantages:

It was very surprising, that during the oxalation of steels having a chrome content <10 wt. % compared to the oxalation of steels having a chrome content of substantially more than 10 wt. %, that such a strong difference in the pickling erosion and in the formation and/or non-formation of oxalate layers took place depending on the presence and/or absence of halogen- and sulfur compounds—as is shown in Table 1.

Due to the absence of halogen- and sulfur compounds and of phosphate, the oxalating method according to the invention is very superior to the oxalating- and zinc phosphating methods of the prior art.

Particularly advantageous in use of the inventive method is the complete or substantial absence of environmentally unfriendly heavy metals and of phosphorus-, halogen- and sulfur compounds. Particularly advantageous with the method according to the invention are the simple bath implementation and the far easier control and regulation of the bath and layer quality by use of testing of the temperature, treatment time and acidity via TA points. Thus the method according to the invention is considerably more simple than e.g. the zinc phosphating. There is also no control and adjustment of the free acid FA, the Fischer total acid number (TAN) and of the acid-value as a ratio of a free acid to the respective total acid which is required.

Namely, because in the oxalating no free acid FS is measurable on account of the complete dissociation of the oxalic acid. A particular advantage of the inventive method is furthermore also the significantly lower accumulation of sludge and complete or substantial absence of environmentally unfriendly heavy metals and other environmentally unfriendly compounds in comparison to phosphating. Thus the disposal cost for sludge and contaminated water is substantially lower and involves significantly less effort and significantly lower costs.

EXAMPLES AND COMPARATIVE EXAMPLES

Prior to coating of metallic substrates with the inventive oxalating composition, four series of experiments to prepare oxalating compositions as concentrates and as bath compositions were performed. In series I the treatment bath was charged with a liquid aqueous concentrate, which was prepared by dissolving a pre-specified quantity of oxalic acid and optionally also by addition of catalyst, pigment, surfactant and/or thickening agent in demineralized water. The dilution factor for diluting a concentrate for the bath preparation was in the range of 1 to 3.

In experimental series II, the treatment bath was prepared with a powdery concentrate, which was prepared by grinding, mixing and/or trituration of powdered oxalic acid and optionally with addition of nitrate dissolved in water, pigment such as e.g. titanium dioxide powder of about 2 μm average particle size for raising the flowability, surfactant and/or thickening agent in a compulsory mixer. The powdery concentrate did not have to be dried in this case and was of higher flowability. The factor for the dissolution of the concentrate in water for the bath preparation was about 1 to 3.

Alternatively, in experimental series III a non-flowable oxalic acid powder was triturated in a kneader with the titanium dioxide to produce a permanently free-flowing product.

For experimental series IV, a paste-like concentrate was produced, in that oxalic acid was combined in a compulsory mixer together with water, with catalyst dissolved in water and optionally with pigment such as e.g. a suspension stabilized by a particle-containing layer structure, surfactant and/or thickening agent. This meterable highly concentrated, one-component paste-like mixture was diluted in dilutions up to a factor of 20 to a bath preparation.

All four experimental series yielded well usable concentrates and bath preparations.

As substrates for the oxalatings and for the cold forming, the following were used:

1) Sheets made of 0.8 mm cold-rolled steel CRS having a carbon content of 0.039 wt. % and having a chrome content of wt. % for deep drawing,
2) Slugs of 27 mm diameter and 13 mm height made of tempered steel 1.0401 having a carbon content of 0.12-0.18 wt. % and having a chrome content of 0 wt. % for cold extrusion,
3) Wire sections of hot-rolled wire made of steel C70W1 of 5.6 mm diameter having a carbon content of 0.7 wt. % and having a chrome content of ≤0.3 wt. % for wire drawing and
4) Wire coil sections made of steel C35BCr1 with 10.5 mm diameter having a carbon content of 0.35 wt. % and a chrome content of 0.1-0.3 wt. % for wire drawing.

In the Tables, the steel material is also apparent from the substrate types.

These substrates were purified first in an aqueous cleaning solution Gardoclean® 351, a phosphate-free strong alkaline purifier of Chemetall GmbH, of 50 g/L at 90° C. for 10 min. The purified substrates were then rinsed with cold tap water one minute, before they were oxalated without prior drying. For this, aqueous solutions or dispersions were prepared with the compositions having tap water listed in the Tables, wherein concentrates of different experimental series as named above were used. If required, a polyethylene glycol having an average molecular weight of about 400 was used as thickening agent 1. Alternatively, Rhodopol® 23, a high molecular weight polysaccharide, was added as thickening agent 2.

After the oxalating, the coated substrate was rinsed with cold demineralized water and then without interim drying was coated in the wet-on-wet-process with an organic polymer-containing aqueous lubricant composition Gardomer® 6332 of Chemetall GmbH to about 2 μm thickness or with drawing soap based on stearate, for example Lubrifil® VA 1520 of Lubrimetal to about 1.5 μm thickness.

The cold forming of the sheets coated and dried with the separating layer or with the separating layer and the lubricant layer took place by deep drawing in a laboratory cup drawing device with a Universal-sheet testing machine of Erichsen Model 142-20 with a cutting force up to 200 kN in one stage of not pre-heated blanks at room temperature.

The cold forming of the slugs coated and dried having the separating layer or those having the separating layer and the lubricant layer took place with a 300 ton press of the May Corp. at 180 tons for 300 ms in one stage of not preheated blanks at room temperature by forward-backward extrusion.

The cold forming of the wire sections and wire coil sections having the separating layer or those having the separating layer and the lubricant layer was carried out with a draw bench at up to 3 tons at room temperature for 300 ms of non-preheated blanks via wire drawing. Here, the wire sections were drawn in the inlet multistage at 0.1-5 m/s.

Only slight scratches as errors of the formed workpieces appeared in the case of too thin, insufficiently closed and/or insufficiently adherent oxalate layers and/or in the case of too thin lubricant layers, but these are not permissible in industrial production.

The cold forming has thus proven to be good, when the oxalate layer has a layer weight of about 5 to 7 g/m$^2$ and the lubricant layer based on organic polymer has a layer weight of about 1.5 g/m$^2$ and when the oxalate layer was closed as much as possible and attached uniformly and adherently to the substrate. The cold forming has thus proven to be very good, when the oxalate layer has a layer weight of about 3 to 4 g/m$^2$ and the lubricant layer based on organic polymer has a layer weight of about 2.5 g/m$^2$ and when the oxalate layer was closed as much as possible and attached uniformly and adherently to the substrate. The cold forming has thus proven to be satisfactory, when the oxalate layer has a layer weight of just under 3 g/m$^2$ and the lubricant layer based on organic polymer has a layer weight of about 2 g/m$^2$ and when the oxalate layer shows a moderate to good adhesiveness. The cold forming has thus proven to be poor, when the oxalate layer was not joined adherently to the substrate, since then a forming was not possible.

In a throughput experiment, different bath compositions were tested at 65° C. and 3 minutes treatment time. As can be inferred from experimental examples VB10 to B16, a bath composition without catalyst was shown to be unsuitable to produce adherent layers for cold forming. Acceleration by a nitro-guanidine catalyst proved to be effective in producing good layers. The consumption of guanidine compound is thereby increased.

It was surprisingly discovered, that a combination of the discussed catalysts, such as seen in B16, display an optimal ratio of adhesiveness, layer quality, coherence, ratio of pickling removal to layer weight, lubricant receptivity and formability with simultaneously reduced consumption of guanidine catalyst. In the throughput tests B17 to B21 it can be seen, that the content of oxalic acid leads to good results over a very wide range.

| Content in g/L | VB10 | VB11 | B12 | B13 | B14 | B15 | B16 |
|---|---|---|---|---|---|---|---|
| Oxalic acid | 40 | 40 | 40 | 40 | 40 | 40 | 40 |
| Nitroguanidine | 0 | 0 | 0 | 0.33 | 10 | 40 | 0.4 |
| $NaNO_3$ | 0 | 2 | 5 | 0 | 0 | 0 | 2 |
| Thickening agent 1 | 10 | 10 | 10 | 10 | 10 | 10 | 10 |
| Total acid TA points | 60 | 60 | 60 | 60 | 60 | 60 | 60 |
| Bath temperature ° C. | 65 | 65 | 65 | 65 | 65 | 65 | 65 |
| Contact time min | 3 | 3 | 3 | 3 | 3 | 3 | 3 |

-continued

| Content in g/L | VB10 | VB11 | B12 | B13 | B14 | B15 | B16 |
|---|---|---|---|---|---|---|---|
| Pickling removal PR g/m$^2$ | 2.5 | 2.9 | 3.9 | 2.0 | 2.2 | 1.9 | 2.5 |
| Layer weight LW g/m$^2$ | 1.9 | 2.9 | 8.6 | 2.8 | 5.4 | 5.1 | 6.8 |
| Ratio PR/LW % | 132 | 100 | 45.3 | 71.4 | 40.7 | 37.3 | 36.8 |
| Steel material blank | CRS sheet | CRS sheet | CRS sheet | CRS sheet | CRS sheet | CRS sheet | CRS sheet |
| Oxalate layer quality | very poor | poor | good | good | very good | very good | very good |
| Oxalate layer | not adherent | not closed | | | | | |
| Lubricant layer | polymer | polymer | polymer | polymer | polymer | polymer | polymer |
| Lubricant layer thickness g/m$^2$ | 1.5 | 1.6 | 1.4 | 1.5 | 1.8 | 1.5 | 1.5 |
| Lubricant quality | very good | very good | very good | very good | very good | very good | very good |
| Cold forming behavior | not possible | poor | good | good | very good | very good | very good |

When the oxalate layer was insufficiently closed, when it even displayed visible uncoated sites to the naked eye, or when it was very inhomogeneous, it was rated at least as poor.

TABLE 3

Bath composition as a function of the oxalic acid content

| | Content in g/L | | | | |
|---|---|---|---|---|---|
| | B17 | B18 | B19 | B20 | B21 |
| Oxalic acid | 5 | 40 | 80 | 150 | 500 |
| Nitroguanidine | 0.4 | 0.4 | 0.4 | 0.4 | 0.4 |
| $NaNO_3$ | 2 | 2 | 2 | 2 | 2 |
| Thickening agent 1 | 10 | 10 | 10 | 10 | 10 |
| Total acid TA points | 8 | 60 | 140 | 260 | 860 |
| Bath temperature ° C. | 65 | 65 | 65 | 65 | 65 |
| Contact time min | 3 | 3 | 3 | 3 | 3 |

TABLE 3-continued

Bath composition as a function of the oxalic acid content

| | Content in g/L | | | | |
|---|---|---|---|---|---|
| | B17 | B18 | B19 | B20 | B21 |
| Pickling removal PR g/m$^2$ | 3.3 | 2.5 | 3.1 | 4.1 | 4.4 |
| Layer weight LW g/m$^2$ | 8.2 | 6.8 | 5.0 | 6.0 | 6.2 |
| Ratio PR/LW % | 40.2 | 36.8 | 62.0 | 68.3 | 70.9 |
| Blank | slug | slug | slug | slug | slug |
| Oxalate layer quality | very good | very good | very good | very good | very good |
| Lubricant layer | polymer | polymer | polymer | polymer | polymer |
| Lubricant layer thickness | 1.3 | 1.4 | 1.6 | 1.4 | 1.5 |
| Lubricant layer quality | very good | very good | very good | very good | very good |
| Cold forming behavior | good | good | good | good | good |

TABLE 4

Layer quality as a function of the treatment temperature during oxalation

| Content in g/L | B22 | B23 | B24 | B25 | B26 | B27 | B28 | B29 |
|---|---|---|---|---|---|---|---|---|
| Oxalic acid | 40 | 40 | 40 | 40 | 40 | 40 | 40 | 40 |
| Nitroguanidine | 0.4 | 0.4 | 0.4 | 0.4 | 0.4 | 0.4 | 0.4 | 0.4 |
| $NaNO_3$ | 2 | 2 | 2 | 2 | 2 | 2 | 2 | 2 |
| Thickening agent 1 | 10 | 10 | 10 | 10 | 10 | 10 | 10 | 10 |
| Total acid TA points | 60 | 60 | 60 | 60 | 60 | 60 | 60 | 60 |
| Bath temperature ° C. | 25 | 35 | 45 | 55 | 65 | 75 | 85 | 90 |
| Contact time min | 15 | 15 | 3 | 3 | 3 | 3 | 3 | 3 |
| Pickling removal PR g/m$^2$ | 2.4 | 2.8 | 1.7 | 1.7 | 2.5 | 3.1 | 4.3 | 4.5 |
| Layer weight LW g/m$^2$ | 4.6 | 7.3 | 3.2 | 4.3 | 6.8 | 7.5 | 10.3 | 10.8 |
| Ratio PR/LW % | 52.2 | 38.4 | 53.1 | 39.5 | 36.8 | 41.3 | 41.7 | 41.7 |
| Blank | slug | slug | slug | slug | slug | slug | slug | slug |
| Oxalate layer quality | sufficient | good | sufficient | very good | very good | very good | good | good |
| Lubricant layer | polymer | polymer | polymer | polymer | polymer | polymer | polymer | polymer |
| Lubricant layer thickness | 1.4 | 1.8 | 2.0 | 2.1 | 1.8 | 1.6 | 1.5 | 1.8 |
| Lubricant layer quality | very good | very good | very good | very good | very good | very good | very good | very good |
| Cold forming behavior | good | very good | good | very good | very good | good | good | good |

When the oxalate layer quality was only sufficient, the layer was somewhat more coarse or not well closed.

TABLE 5

Layer quality as a function of various catalysts.

| Content in g/L | VB30 | VB31 | VB32 | B33 | VB34 | VB35 |
|---|---|---|---|---|---|---|
| Oxalic acid | 40 | 40 | 40 | 40 | 40 | 40 |
| Nitroguanidine | — | — | — | — | — | — |
| SNBS | 1 | — | — | — | — | — |
| $NaNO_3$ | — | | — | 5 | 1 | 2 |
| Sodium chlorate | — | 1 | 4 | — | — | — |
| Thickening agent 1 | — | — | — | — | — | — |

TABLE 5-continued

Layer quality as a function of various catalysts.

| Content in g/L | VB30 | VB31 | VB32 | B33 | VB34 | VB35 |
|---|---|---|---|---|---|---|
| Total acid TA points | 60 | 60 | 60 | 60 | 60 | 60 |
| Bath temperature ° C. | 65 | 65 | 65 | 65 | 65 | 65 |
| Contact time min | 3 | 3 | 3 | 3 | 3 | 3 |
| Pickling removal PR g/m$^2$ | 2.2 | 2.1 | 2.6 | 3.9 | 1.2 | 0.9 |
| Layer weight LW g/m$^2$ | 2.7 | 4.1 | 2.1 | 8.6 | 1.2 | 1.5 |
| Ratio PR/LW % | 81.5 | 51.2 | 124 | 45.3 | 100 | 60.0 |
| Blank | slug | slug | slug | slug | slug | slug |
| Oxalate layer quality | poor | sufficient | poor | good | poor | poor |
| Lubricant layer | polymer | polymer | polymer | polymer | polymer | polymer |
| Lubricant layer thickness | 1.4 | 1.8 | 1.4 | 1.9 | 2.1 | 1.6 |
| Lubricant layer quality | very good | very good | very good | very good | very good | very good |
| Cold forming behavior | poor | sufficient | poor | good | poor | poor |

Good oxalate layers were produced with catalysts according to the invention, with other catalysts rather poor layers. When the oxalate layer quality was only sufficient, the layer was somewhat more coarse or not well closed.

TABLE 6

Layer quality as a function of the contact time

| Content in g/L | B36 | B37 | B38 | B39 | B40 | B41 |
|---|---|---|---|---|---|---|
| Oxalic acid | 40 | 40 | 40 | 40 | 40 | 40 |
| Nitroguanidine | 0.4 | 0.4 | 0.4 | 0.4 | 0.4 | 0.4 |
| Thickening agent 1 | 10 | 10 | 10 | 10 | 10 | 10 |
| $NaNO_3$ | 2 | 2 | 2 | 2 | 2 | 2 |
| Total acid TA points | 60 | 60 | 60 | 60 | 60 | 60 |
| Bath temperature ° C. | 65 | 65 | 65 | 65 | 65 | 65 |
| Contact time min | 1 | 2 | 3 | 5 | 10 | 20 |
| Pickling removal PR g/m$^2$ | 1.2 | 2.1 | 2.2 | 4.0 | 5.0 | 4.8 |
| Layer weight LW g/m$^2$ | 2.6 | 4.9 | 6.0 | 9.6 | 11.1 | 10.8 |
| Ratio PR/LW % | 46.2 | 42.9 | 36.7 | 41.7 | 45.0 | 44.4 |
| Blank | slug | slug | slug | slug | slug | slug |
| Oxalate layer quality | sufficient | sufficient | very good | very good | good | good |
| Lubricant layer | polymer | polymer | polymer | polymer | polymer | polymer |
| Lubricant layer thickness | 1.6 | 1.8 | 1.7 | 1.8 | 1.6 | 1.4 |
| Lubricant layer quality | very good | very good | very good | very good | very good | very good |
| cold forming behavior | sufficient | good | very good | very good | good | good |

When the oxalate layer was only sufficient, the layer was not well closed.

TABLE 7

Examples of various blanks, with different thickening agents and drawing soaps instead of polymer-based lubricant composition

| Content in g/L | B42 | B43 | B44 | B45 | B46 | B47 |
|---|---|---|---|---|---|---|
| Oxalic acid | 40 | 40 | 40 | 40 | 40 | 40 |
| Nitroguanidine | 0.4 | 0.4 | 0.4 | 0.4 | 0.4 | 0.4 |
| Thickening agent no. | 2:10 g/L | 2:10 g/L | 1:10 g/L | 1:10 g/L | 2:10 g/L | 1:10 g/L |
| $NaNO_3$ | 2 | 2 | 2 | 2 | 2 | 2 |
| Total acid TA points | 60 | 60 | 60 | 60 | 60 | 60 |
| Bath temperature ° C. | 65 | 65 | 65 | 65 | 65 | 65 |
| Contact time min | 3 | 3 | 3 | 3 | 3 | 3 |
| Pickling removal PR g/m$^2$ | 2.1 | 2.1 | 2.2 | 2.3 | 2.0 | 2.4 |
| Layer weight LW g/m$^2$ | 5.3 | 4.9 | 6.0 | 5.1 | 5.4 | 6.3 |
| Ratio PR/LW % | 39.6 | 42.9 | 36.7 | 45.1 | 37.0 | 38.1 |
| Blank | slug | wire coil | slug | wire coil | wire | wire coil |
| Steel material | C15 | C35BCr1 | C15 | C35BCr1 | C70W1 | C35BCr1 |
| Oxalate layer quality | very good | very good | very good | very good | very good | very good |
| Lubricant layer | polymer | polymer | polymer | polymer | drawing soap | drawing soap |
| Lubricant layer thickness | 1.6 | 1.8 | 1.7 | 1.8 | 1.5 | 1.4 |
| Lubricant layer quality | very good | very good | very good | very good | very good | very good |
| Cold forming behavior | very good | very good | very good | very good | very good | very good |

It was discovered, that the oxalate layers according to the invention have surface properties, which are particularly well-suited for lubricant application and for cold forming.

A layer has proven itself to be a very good oxalate layer, which adheres to the substrate and is sufficiently thick and as a rule is at least 1 μm thick, if thereafter a lubricant layer is applied prior to the cold forming, or is at least 2 μm thick as a rule when thereafter no lubricant layer is applied prior to the cold forming.

An oxalate layer has proven to be a less good layer, which has an insufficient adherence and/or an insufficiently closed layer on the substrate.

These properties may be a result of insufficient catalyst action due to deficient content of at least one catalyst and/or a consequence of unsuitable bath control, for example treatment times being too low and/or insufficiently low bath temperature. Insufficiently closed oxalate layers with a degree of coherence of ≤90 surface area-% may lead to increased wear, scoring, and similar faults of formed bodies during the cold forming to welds of blanks and tools.

The oxalate layer having too little thickness and too little layer weight displayed a lowered adhesiveness. A thickness of the oxalate layer measured as a layer weight of about 1 $g/m^2$ is usually adequate, if the oxalate layer is closed and sufficiently adherent on the metallic substrate. It is advantageous at higher degrees of cold forming, if the oxalate layer has a layer weight of at least 2 $g/m^2$. Therefore, the performance of the oxalate layer in cold forming is more important than the thickness of the oxalate layer. The layer performance will only be recognizable during the forming.

The tests demonstrate very definitely, that the quality of the cold forming depends primarily on quality of the oxalate layer and thus of the sufficient coherence, adhesion and thickness of the oxalate layer. The lubricant layer based on organic polymer and/or copolymer is of great performance and robustness in cold forming. The lubricant layer based on drawing soap also demonstrated a very good performance in cold forming in further tests not shown here in detail.

The lubricant layer is also usually sufficient with layer weight of about 1 $g/m^2$. When the operation is carried out with an oxalate layer and without a lubricant layer, the increased coefficient of friction plays a role. In some cases a cold forming is then already quite possible, in particular at low degrees of forming and/or with sufficiently closed, fine crystalline layers. Overall the tests demonstrated, that the use of nitrate and a guanidine based catalyst in combination have led to a reduction of consumption and are ideal for the formation of phosphate-free conversion layers for cold forming at temperatures of 60 to 65° C. and contact times of 3 to 5 minutes. Thereby it was found, that the use of polymer-based lubricant compositions is particularly suitable in view of the excellent sliding properties thereof.

It turned out, that the addition of nitroguanidine acts as a catalyst, but not as a pickling inhibitor. It obviously has—unlike alkali-, manganese- and zinc phosphate—an oxidizing effect and accelerates the synthesis of the oxalate layer. However, it behaves differently in oxalating than in phosphating and is consumed in the oxalating exceptionally strongly, while in phosphating no consumption of this catalyst was found. Thus it does not act as a pickling inhibitor, because the addition of larger amounts of nitroguanidine does not lead to an Inhibition of the acid, but rather to an accelerated buildup of the oxalate layer, the addition of suitable amounts of nitroguanidine reduces the contact time which is necessary to form a completely closed and fine crystalline oxalate layer. When metallic bodies were immersed in the oxalating composition of the invention, rising gas bubbles were often visible for about 5 to 10 minutes, so the gas time of the gases is measurable. Here it was found, that at the end of the gas time, thus the time of the contact of the metallic surface with the acidic oxalating composition during oxalating, that the oxalate layer is substantially closed and well structured. Therefore, there is an indication very visible from the outside accompanying the evolution of gas during the oxalating, when the oxalating has progressed to a well-formed oxalate layer. It was also found, that the ratio of pickling removal to layer weight at the end of gas time came very close to the theoretical maximum, without drastically reducing the pickling removal. This means, that in the ideal case nearly 100 wt. % of the iron dissolved out is deposited stoichiometrically again as iron oxalate on the substrate surface.

With regard to the content of oxalic acid, the experiments revealed that an oxalate layer was formed over a very wide concentration range of oxalic acid of approximately 1 to about 500 g/L.

Regarding the addition of nitroguanidine, the experiments revealed that this catalyst is helpful in forming the layer over a very wide concentration range approximately from 0.08 to 20 g/L, whereby the layer formation is accomplished more quickly at higher nitroguanidine concentrations. This also demonstrates, that nitroguanidine does not act as a pickling inhibitor, but rather as a catalyst and that the addition of a pickling inhibitor to the aqueous composition of the invention is not necessary.

Regarding the addition of nitrate, the tests demonstrated that this catalyst makes possible a co-acceleration with nitroguanidine. This system is far less consumptive, but offers all advantages. With regard to the nitrate content, the tests also showed that the use of high contents of nitrate by itself resulted in somewhat thicker layers and slightly reduced adhesiveness. Suitable layer quality resulted only by combination with nitroguanidine.

With regard to the combination of nitrate and nitroguanidine, the results show that a ratio of about 0.4 g/L nitroguanidine to 2 g/L nitrate makes possible particularly good oxalate layers and is less consumptive at the same time.

Regarding the pickling removal, the tests demonstrate that the pickling removal also increases with increasing temperature and/or with increasing oxalic acid concentration. It was found, that as a general rule, the pickling removal in a sufficiently accelerated system stands in a certain ratio to the layer weight.

As to the layer formation, the tests show that a layer formation with the aqueous composition of the invention is possible throughout the temperature range of 10 to 90° C., but that at higher temperature and otherwise the same conditions such as the same concentration and contact time, a larger layer thickness is formed.

The tests regarding the layer weight demonstrated that the layer weight increases with the temperature of the bath and also may depend on whether sufficient catalyst is present.

With regard to the ratio pickling removal PR to layer weight LW, the tests show that the ratio should be approximately in the range from 30 to 75%. For the adhesiveness of the oxalate layers on the metallic substrate, the tests show that the adhesiveness is positively influenced by a proper ratio of pickling removal to layer buildup and is negatively influenced with unsuitable catalysts or too low or too high concentrations thereof.

With regard to the sludge formation, the tests demonstrated that substantially less sludge is formed than in a phosphating comparable thereto. The sludge formation depends strongly on the pickling attack.

The invention claimed is:

1. A method for treatment of shaped bodies comprising:

contacting at least one shaped body with an aqueous acidic composition to form a conversion layer on a surface of the at least one shaped body, wherein the surface comprises iron or steel and a carbon content in a range of 0 to 2.06 wt. % and a chrome content in a range of 0 to <10 wt. % and wherein the surface is optionally galvanized or alloy galvanized and wherein the aqueous acidic composition consists essentially of:

water;

from 2 to 500 g/L oxalic acid calculated as anhydrous oxalic acid;

from 0.01 to 20 g/L of at least one catalyst based on guanidine calculated as nitroguanidine, nitrate calculated as sodium nitrate or combinations thereof;

optionally at least one thickening agent based on at least one compound of polyacrylamide, polyallylamine, polyethylene glycol, polysaccharide, polysiloxane, polyvinylamide, polyvinylamine or combinations thereof;

optionally a pigment for the flowability of the oxalic acid;

optionally at least one surfactant;

optionally drying the conversion layer to form a dried conversion layer comprising a layer weight in a range of 1.5 to 15 g/m$^2$ measured by gravimetric determination according to DIN EN ISO 3892;

optionally contacting the conversion layer with a lubricant composition to form a lubricant layer; and optionally drying the lubricant layer to form a dried lubricant layer;

wherein a pickling removal of the aqueous acidic composition is in a range of 1 to 6 g/m$^2$ measured by gravimetric determination according to DIN EN ISO 3892, a ratio of pickling removal to layer weight PR:LW of the dried conversion layer is in a range of 0.30:1 to 0.75:1, and the dried conversion layer forms a firmly adherent coating on the surface, and wherein the aqueous acidic composition is substantially free of halogen compounds, phosphorus compounds, sulfur compounds, and heavy metals other than iron and zinc.

2. The method of claim 1, wherein a ratio of concentration of oxalic acid to the at least one catalyst is in a range of 500:1 to 2:1.

3. The method of claim 1, wherein the aqueous acidic composition comprises at least one pigment in a range of 0.001 to 20 g/L.

4. The method of claim 1, wherein the aqueous acidic composition comprises the at least one surfactant and wherein the at least one surfactant is stable in strong acid of the oxalating composition such that the aqueous acidic composition further cleans the surface.

5. The method of claim 1, wherein the aqueous acidic composition comprises the at least one thickening agent in a range of 0.01 to 50 g/L.

6. The method of claim 1, wherein the water comprises demineralized water.

7. The method of claim 1, wherein the method comprises forming the lubricant layer and the lubricant composition comprises soap, oil, organic polymer, organic copolymer or combinations thereof.

8. The method of claim 1, wherein the shaped body is cold formed by flow turning, ironing, roll threading, thread tapping, slip-type drawing, cold extrusion, cold massive forming, cold heading, pressing, deep drawing or combinations thereof.

* * * * *